US006159602A

United States Patent [19]

Kadokura et al.

[11] Patent Number: 6,159,602

[45] **Date of Patent: *Dec. 12, 2000**

[54] ELECTRODEPOSITION COATED MATERIAL

[75] Inventors: Susumu Kadokura; Tomoaki Kato, both of Sagamihara, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/589,309

[22] Filed: Jan. 22, 1995

Related U.S. Application Data

[63] Continuation of application No. 08/138,983, Oct. 21, 1993, abandoned.

[30] Foreign Application Priority Data

Oct. 27, 1992 [JP] Japan ..... 4-288849

[51] Int. Cl.[7] ..... C25D 13/00

[52] U.S. Cl. ..... 428/403; 204/496

[58] Field of Search ..... 204/484, 496, 204/508; 252/520.1, 520.2; 428/403

[56] References Cited

U.S. PATENT DOCUMENTS

| | | | |
|---|---|---|---|
| 3,408,278 | 10/1968 | Stoodley | 204/484 |
| 4,097,351 | 6/1978 | Caley et al. | 204/181.6 |
| 4,113,598 | 9/1978 | Jozwiak et al. | 4/9 |
| 4,317,855 | 3/1982 | Guillaumon et al. | 428/212 |
| 4,452,830 | 6/1984 | Yoshizumi | 428/403 |
| 4,655,966 | 4/1987 | Guillaumon et al. | 252/518 |
| 4,745,012 | 5/1988 | Lo | 204/487 |
| 4,746,408 | 5/1988 | Hyner et al. | 204/40 |
| 5,145,733 | 9/1992 | Kadokura | 428/551 |
| 5,178,736 | 1/1993 | Richardson | 204/181.7 |
| 5,186,802 | 2/1993 | Kadokura | 204/118.4 |
| 5,238,544 | 8/1993 | Kadokura et al. | 204/181.4 |

*Primary Examiner*—Kishor Mayekar
*Attorney, Agent, or Firm*—Fitzpatrick, Cella, Harper & Scinto

[57] ABSTRACT

An electrodeposition paint includes a multiphase constructed fine powder in a resin. The fine powder contains at least metal oxide. The present invention also includes an electrodeposition coated material. It is produced by coating a substrate with an electrodeposition coating formed of the electrodeposition paint. The present invention further discloses a method of producing the electrodeposition coated material. The electrodeposition coating is formed on the substrate using the electrodeposition paint by an electrodeposition coating process. Then, it is cured.

4 Claims, 2 Drawing Sheets

ELECTRODEPOSITION COATED MATERIAL

This application is a continuation of application Ser. No. 08/138,983 filed Oct. 21, 1993, now abandoned.

BACKGROUND OF THE INVENTION

1. Field of the Invention

The present invention relates to an electrodeposition paint and an electrodeposition coated material which are used for optical apparatuses, electric appliances, acoustic machines, communication machines, home appliances, office machines, and the like. The invention has also been found to be suitable for wall materials of a clean room, for enhancing static-electricity resistance and for forming a decorative surface. The present invention also relates to a method of producing the electrodeposition coated material.

2. Description of the Related Art

Conventionally, the following methods are available for forming a coated material having static-electricity resistance and which is used, for example, in optical apparatuses, electric appliances, acoustic machines, communication machines, home appliances, office machines, and for wall materials of a clean room. The main method employed is by spray-coating a suitable substrate with a conductive paint so as to form a coating. Other methods such as filling a conductive filler in a resin, mixing a surface active agent with a resin, and the like, are also available.

However, the above conventional methods have presented problems. In the above method of spray-coating a suitable substrate with a conductive paint so as to form a coating, the volume resistivity of the coated material is varied depending on the aspect ratio of the conductive filler. For example, since a spherical conductive filler has a low aspect ratio, the targeted volume resistivity cannot be achieved unless the filler content in the paint is 50% by weight or more. Moreover, the excessive conductive filler content deteriorates the durability of the coating. Hence, it is difficult to apply such a coated material to the product, and the cost is expensive.

In order to solve the above problems, a conductive filler which has the shape of a short fiber, a needle, a scale, or a sphere having a sharp projection, and which has a high aspect ratio, is added to the paint. Only a small amount of such a conductive filler is necessary to sufficiently produce positive influences exceeding those of a spherical filler. However, the above method also possesses drawbacks, and, consequently, the resulting coated material obtained by this method is not suitable for practical use. For instance, an elongated conductive filler is hardly ever dispersed in a resin or paint, or the conductive filler may be broken, thus lowering the high aspect ratio, and further preventing quantity production.

Further, a coated material can be formed by mixing a surface active agent instead of the conductive filler, in order to solve the above problems. However, the surface active agent tends to be denatured with the lapse of time due to exposure to temperature or light, or it produces no effect in a dry atmosphere, thus deteriorating the value of the commercial product. Additionally, nonuniformity of the filling is caused and anisotropy occurs in conductive characteristics during plastic injection molding.

SUMMARY OF THE INVENTION

Accordingly, in order to overcome the above conventional drawbacks, an object of the present invention is to provide an electrodeposition paint and an electrodeposition coated material which have good uniformity and static-electricity shielding characteristics regardless of the shape of the filler and which are applicable to the product used as a decorative coating, and also to provide a method of producing the electrodeposition coated material.

To achieve the above object, the present invention provides an electrodeposition paint comprising a multiphase fine powder in a resin, the fine powder containing at least metal oxide. That is, the invention includes an electrodeposition paint comprising a fine powder in a resin, said fine powder being a multiphase fine powder formed of a plurality of materials, including at least one metal oxide. Each particle of the fine powder is formed of such material including a metal oxide by being coated with a coating layer or doped with a dopant on the surface, or the like.

The present invention also provides an electrodeposition coated material produced by coating a substrate with an electrodeposition coating formed of the electrodeposition paint.

The present invention further provides a method of producing the electrodeposition coated material comprising the steps of: providing an electrodeposition paint comprising a multiphase powder, said powder comprising particles formed of a plurality of materials including at least one metal oxide; forming an electrodeposition coating with said electrodeposition paint; coating said electrodeposition coating on a substrate, and coating said electrodeposition coating.

Further objects, features and advantages of the present invention will become apparent from the following description of the preferred embodiments with reference to the attached drawings.

DETAILED DESCRIPTION OF THE PREFERRED EMBODIMENTS

Figure 1:
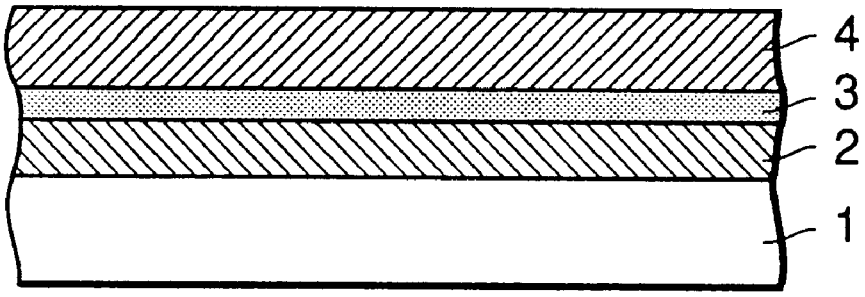
FIG. 1 is a sectional view showing one example of an electrodeposition coated material according to the present invention.

The electrodeposition paint of the present invention is used for coating optical apparatuses, electric appliances, or the like, so as to form an electrodeposition coating. The coating is formed by an electrodeposition coating process, in order to improve electrostatic shielding and outer decorative characteristics. The electrodeposition paint of the present invention is obtained by adding a filler to an electrodepositable resin and is used for the deposition coating process. The electrodeposition coating process is employed whereby a pair of electrodes are placed in the electrodeposition paint and a DC voltage is applied thereto, thereby attaching a material in the electrodeposition paint onto the electrode. Thus, the subject coated is used as one electrode, and a stainless sheet, for example, can be used as the other electrode.

The depositable resins used for the electrodeposition paint of the present invention employ low-temperature curing resins such as acrylic-melamine, acrylic, epoxy, urethane, fluorine, alkyl resins, and the like.

Although the electrodepositable resins used for the electrodeposition paint according to the present invention may be either an anionic resin or a cationic resin, a water-soluble resin or water-dispersed resin having a carboxyl group is preferable for practical use.

It is preferable that the electrodeposition paint of the present invention be produced by dissolving or dispersing a desired resin into water. However, organic solvents, such as alcohol or glycol ether solvents, may be further added. An organic solvent content of a low percentage by weight is sufficient, preferably in the range of between 2–5% by weight.

The resin concentration of the electrodeposition paint according to the present invention is preferably between 7–20% by weight, and more preferably, between 7–17% by weight. Also, the electrodeposition paint of the present invention may be colored by adding a conventionally known pigment, or the like, when necessary. The pigment content for coloring is preferably between 1–3% by weight.

Fine powder having a multiphase composition and including at least metal oxides is used for a filler contained in the electrodeposition paint of the present invention. The fine powder having a multiphase composition is such that each particle forming the fine powder is formed of a plurality of materials. The particles may be coated with a coating layer, doped with a dopant on the surface of the particles, or the like, so as to provide multi phases depending on the kinds of material and the mixing ratio.

Further, in the present invention, the fine powder formed of fine particles having multi-phases includes metal oxides. That is, among a plurality of materials forming the particle, at least one material is a metal oxide.

Titanium oxide, tin oxide, antimony oxide, indium oxide and zinc oxide, or the like, are preferably used as a metal oxide present in the particles forming the fine powder.

Other materials forming the fine powder particles, except for metal oxides, are, for example, antimony, aluminum borate and carbon black.

The multiphase fine powder is preferably formed of, for example: the particles obtained by coating the surface of the titanium oxide particles with tin oxide; the particles obtained by doping the surface of tin oxide particles with antimony oxide; the particles obtained by doping the surface of the indium oxide particles with antimony oxide; the particles obtained by coating the surface of the titanium oxide particles with tin oxide and further doping with antimony oxide; the particles obtained by coating the surface of the titanium oxide particles with zinc oxide; the particles obtained by doping the surface of zinc oxide particles with antimony oxide; and The thickness of the coating layer or the layer containing a dopant is preferably between 1/200–1/10 of the particle size.

The average particle size of the multiphase fine powder is preferably between 0.01–5 μm, and more preferably, between 0.01–2.0 μm. An average size of less than 0.01 μm is likely to cause a problem in dispersibility in the secondary aggregation performance, whereas an average size of more than 5 μm is also likely to cause a problem in decorative characteristics and sedimentation performance.

In the present invention, the fine particle size is measured by a centrifugal sedimentation-type particle size distribution meter, SACP-3 (made by Shimadzu Corporation).

In the electrodeposition paint of the present invention, a ratio of the content of the multiphase fine powder to the electrodepositable resins is preferably between 2–150 parts by weight, and more preferably, between 7–40 parts by weight to 100 parts by weight. Less than 2 parts by weight of the fine powder weakens the effect of preventing static electricity, whereas more than 150 parts thereof is likely to lower the decorative and durability characteristics.

The powder precipitation can be observed by an X-ray microanalyzer and the precipitated amount can be measured by performing a thermogravimetric analysis.

As a filler, a ceramic powder or carbon black, in addition to the multiphase fine powder, may be added to the electrodeposition paint of the present invention. The ceramic powders include, for example, alumina, silica, zirconia, magnesia, titanium oxide, silicon nitride, silicon carbon and aluminum nitride. The average particle size of the ceramic powder and the carbon black is preferably between 0.01–3 μm, and more preferably, between 0.2–2 μm. An average size of less than 0.01 μm is likely to cause a problem in dispersibility of secondary aggregation performance, whereas average size of more than 4 μm is also likely to cause a problem in terms of decorative characteristics and sedimentation performance.

When ceramic powder or carbon black is added to the electrodeposition paint of the present invention, a ratio of the ceramic powder or carbon black content to the multiphase fine powder is preferably between 2–150 parts by weight to 100 parts by weight.

An electrodeposition coating having a suitable resistance for shielding static electricity can be formed by using the electrodeposition paint of the present invention. The volume resistivity for shielding static electricity is preferably between $10^2$–$10^9$ Ω·cm.

The electrodeposition coated material of the present invention is achieved by forming an electrodeposition coating on a metal substrate or a non-metal substrate having a thin metal film on the surface using the electrodeposition paint of the present invention by the electrodeposition coating process.

Referring to FIG. 1, the electrodeposition coated material of the present invention is achieved by coating a non-metal substrate 1 having a thin metal film 2 with an adhesion-improving coating 3 and an electrodeposition coating 4 including a precipitated filler. The adhesion-improving coating 3 may be coated, if necessary.

A description will now be given of a method of producing the electrodeposition coated material according to the present invention shown in FIG. 1.

A thin metal film 2 is first formed on the surface of the non-metal substrate 1. Then, the adhesion-improving coating 3 is further coated by a chemical treatment in order to improve adhesion characteristics.

The non-metal substrate 1 can be any plastic without any particular specification which is used for equipment such as electric machines, communication machines, home electric appliances, and the like. For example, ABS, polycarbonate, polycarbonate/ABS, denatured PPE, or plastic containing a glass fiber, a carbon fiber, or the like, may be included in the non-metal substrate 1.

A method of forming the thin metal film 2 on the non-metal substrate 1 is preferably employed by performing electroless copper plating, electroplating, dry plating, vapor-deposition, or the like. The thickness of the thin metal film is 5 μm or less, and more preferably, between 0.1–2 μm. The thin metal film 2 is formed by plating, by a generally known plating process on plastic. Etching and a catalytic treatment are then performed, and the thin metal film 2 is formed.

Nickel, copper, gold, silver, aluminum, chromium, or an alloy of these elements can be used as the thin metal film 2.

The thin metal film 2 may be treated by chromic acid, chemical coloring, a surface active agent, or black chromium electroplating, or the like, when necessary in order to improve adhesion characteristics. Thus, a metal can be prevented from being eluted into an electrodeposition paint bath by performing a chemical or electrochemical treatment on the surface of the thin metal film 2. The thickness of the adhesion-improving coating is preferably between 0.1–0.5 μm.

Subsequently, the electrodeposition coating 4 is formed on the substrate 1 using the electrodeposition paint of the present invention by the electrodeposition coating process. The electrolysis conditions are preferably at a temperature of between 20–25° C., a hydrogen exponent of between pH 8–9, and a voltage of between 30–120V.

Lastly, the electrodeposition coating 4 is cured at a low temperature, thereby obtaining the electrodeposition coated material of the present invention. The preferable curing conditions are such that the electrodeposition coating 4 should be cured in the oven at a temperature of between 90–100° C. for between 20–180 minutes.

Figure 2:
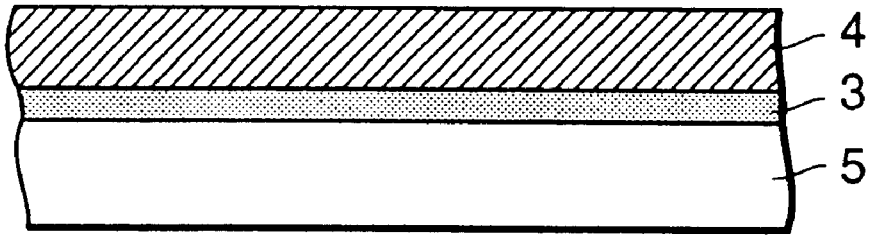
FIG. 2 is a sectional view showing another example of the electrodeposition coated material according to the present invention.

FIG. 2 is a sectional view showing another embodiment of the construction of the electrodeposition coated material according to the present invention. The electrodeposition coated material shown in FIG. 2 can be achieved by coating the adhesion-improving coating 3 on a metal substrate 5 when necessary and by further coating the electrodeposition coating 4 including a filler on the adhesion-improving coating 3.

Copper, brass, aluminum, iron or alloys of these elements, for example, can be used as the metal substrate 5.

Further, another method of producing the electrodeposition coated material according to the present invention shown in FIG. 2 is employed as follows. The adhesion-improving coating 3 is formed on the metal substrate 5, for example, on a brass substrate, by a process similar to the process shown in FIG. 1, for example, by forming copper oxide using alkali, and the electrodeposition coating 4 is formed on the adhesion-improving coating 3 in a process similar to the electrodeposition coating process indicated in FIG. 1. Then, the electrodeposition coating layer 4 is cured at a low temperature. As a result, the electrodeposition coated material can be obtained.

In the electrodeposition coated material of the present invention, the thickness of the electrodeposition coating is generally between 5–40 μm, and more preferably, between 7–30 μm.

Further, the precipitated amount of the filler in the electrodeposition coating 4 is preferably between 10–60% by weight, and more preferably, between 10–50% by weight, and further more preferably, between 10–35% by weight.

Since the electrodeposition coated material of the present invention has an electrodeposition coating including the precipitated fine powder having the multiphase composition with metal oxides, it has good static-electricity resistance and decorative characteristics, thus improving the value of the commercial products.

Figure 3:
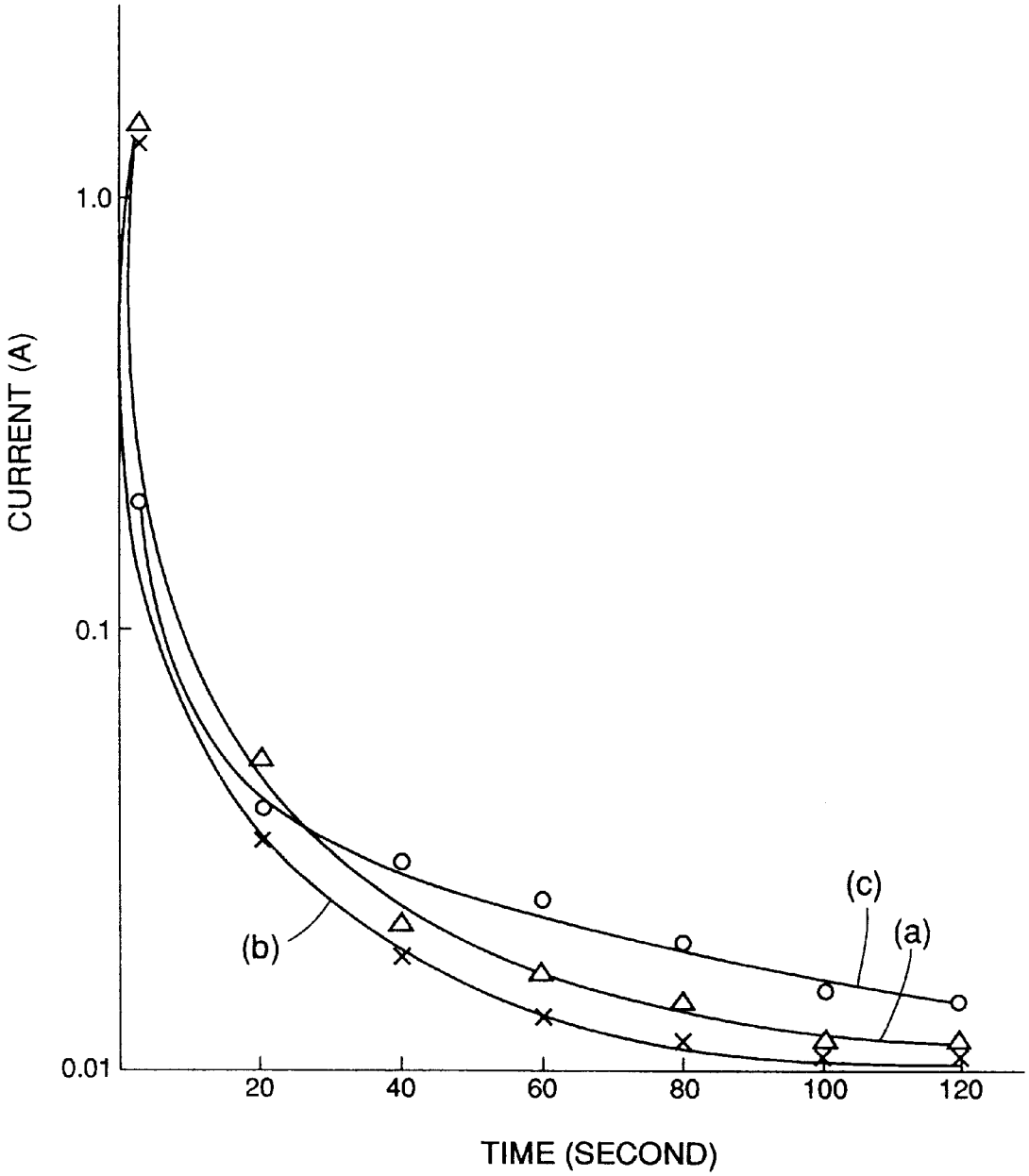
FIG. 3 is a graph indicating a current-time curve in forming an electrodeposition coating.

FIG. 3 indicates the current-time curves obtained by performing electrodeposition coating on three kinds of electrodeposition paints. As can be seen from the current-time curves, the electrodeposition coatings have high precision.

All the resulting electrodeposition coated materials have the structure shown in FIG. 1 achieved by the following process. An ABS resin is used as the non-metal substrate 1. An aluminum film used as the thin metal film 2 is formed on the ABS resin and the adhesion-improving coating 3 is further formed on the aluminum film by a chemical treatment as described above. Lastly, the respective electrodeposition coatings are formed by utilizing the three kinds of electrodeposition paints so as to produce the three kinds of electrodeposition coated materials.

Among the three kinds of electrodeposition paints, a first paint is achieved by dispersing 5 parts by weight of the multiphase fine powder formed of fine particles obtained by coating $TiO_2$ with $SnO_2$ in 100 parts by weight of an acrylic-melamine resin. The average particle size of the fine powder used for the first electrodeposition paint is 0.2 μm. The current-time curve of the first electrodeposition paint is indicated by the graph (a) in FIG. 3.

A second electrodeposition paint is obtained by dispersing 70 parts by weight of the multiphase fine powder formed of fine particles obtained by coating $TiO_2$ with $SnO_2$ and 30 parts by weight of the alumina powder in 100 parts by weight of an acrylic-melamine resin. The average particle size of the fine powder used for the second electrodeposition paint is 0.2 μm and that of alumina is 0.5 μm. The current-time curve of the second electrodeposition paint is indicated by the graph (b) in FIG. 3.

A third electrodeposition paint is formed only of an acrylic-melamine resin without a filler. The current-time curve of the third electrodeposition paint is indicated by the graph (c) in FIG. 3.

The electrodeposition coatings of the respective electrodeposition paints are performed by applying voltage of 90V for 2 minutes.

As can be seen from FIG. 3, a rapid current attenuation is more detectable with a lapse of time in the first and second electrodeposition paints (indicated by (a) and (b) of the graph) than in the third electrodeposition coated materials without a filler. Thus, it can be validated that the deposited coatings of the first and second paints have higher precision.

The present invention will now be described more specifically with reference to examples. However, it is to be understood that the invention is not limited to the disclosed examples.

EXAMPLE 1

An ABS substrate (made by Denki Kagaku Kogyo K.K.) having a length of 100 mm, a width of 50 mm and a thickness of 0.7 mm was treated with a $CrO_3$—$H_2SO_4$—$H_2O$ etching liquid for 1 minute and washed. Then, the substrate was treated with 30 g/l of primary tin chloride and 20 ml/l of hydrochloric acid used as a sensitizer liquid for 2 minutes at room temperature and washed. Subsequently, the substrate was further treated with 0.3 g/l of palladium chloride and 3 ml/l of hydrochloric acid used as an activator liquid for 2 minutes at room temperature, and the resulting ABS substrate was formed. The substrate was further plated with an electroless copper plating liquid (made by Okuno Chemical Industry Co.,Ltd.) having a pH 13.0 for 3 minutes at a bath temperature of 70° C., so as to form a thin copper film having a thickness of 0.2 μm. Thereafter, the substrate was treated with an aqueous solution containing 5% sodium hydroxide and 1% potassium persulfate for 30 seconds at a temperature of 70° C. so as to form a copper oxide coating in the form of a chemical coloring coating on the thin copper film.

70 parts by weight of a filler having an average particle size of 0.2 μm (the powder formed of the particles obtained by coating $TiO_2$ with $SnO_2$; brand name: ET-500W, made by Ishihara Sangyo Kaisha, Ltd.) were added to 100 parts by weight of an acrylic-melamine resin (brand name: Honey Brite C-11, made by Honey Chemical Co.,Ltd.). The resultant mixture was dispersed by a ball mill for 30 hours, and then diluted to 15% by weight with desalted water. In a paint containing 2.0% by weight of carbon black for coloring, electrodeposition was performed by utilizing the resultant substrate as the anode and a stainless sheet having a thickness of 0.5 mm as the cathode at an applying voltage of 100V for 2 minutes under the conditions of a bath temperature of 25° C. and pH 8–9. After electrodeposition, the substrate was washed and heated for 60 minutes in an oven at a temperature of 97° C.±1° C. so as to be cured. Thus, the electrodeposition coated material having a good outer appearance according to the present invention was obtained.

The thickness of the electrodeposition coating forming the electrodeposition coated material was 20 μm and the precipitated amount thereof was 30% by weight. The adhesion characteristics test (according to JIS K5400 cross-cut adhesion test) and corrosiveness test (according to JIS K5400 salt spray test) were performed on the electrodeposition coating.

The result of the adhesion characteristics test was 100/100, that is, no peeling of the electrodeposition coating occurred. The result of the corrosiveness test was that no expansion caused by corrosion of the electrodeposition coating was detected whatsoever even after 500 hours of testing.

Further, the static-electricity shielding effect was confirmed by measuring the volume resistivity of the electrodeposition coated material. The measurement was performed by using an electrodeposition coated material produced by varying the filler content in the electrodeposition paint as shown in Table 1 and maintaining the other conditions the same as those of the above electrodeposition coated material. The volume resistivity was measured according to JIS K6911. The results are shown in Table 1.

TABLE 1

| Fine powder content | Volume resistivity (Ω · cm) |
|---|---|
| 10 wt% | $10^8$ |
| 20 wt % | $10^6$ |
| 30 wt % | $10^3$ |
| 40 wt % | $10^2$ |
| 50 wt % | $10^2$ |

As can be seen from Table 1, satisfactory volume resistivity is obtained by adding the multiphase fine powder to the electrodeposition coating.

Comparative Example 1

Another electrodeposition coated material was produced in a manner similar to Example 1, except that the fine powder was not included in the electrodeposition coating. The volume resistivity of the electrodeposition coated material was measured in a manner similar to that in Example 1. As a result, it was found that the electrodeposition coated material of this Example had a higher volume resistivity of $10^{13}$ (Ω·cm)

EXAMPLE 2

An ABS substrate (made by Denki Kagaku Kogyo K.K.) similar to that of Example 1 was formed in a manner similar to Example 1. The substrate was further plated with an electroless copper plating liquid (made by Okuno Chemical Industry Co.,Ltd.) having a pH 13.0 for 10 minutes at a bath temperature of 70° C. so as to form a thin copper film having a thickness of 0.5 μm. Then, the substrate was treated with an aqueous solution containing 0.1% potassium dichromate for 1 minute at a temperature of 70° C. so as to form a chromium coating on the thin copper film.

70 parts by weight of a filler having an average particle size of 0.1 μm (the powder formed of the particles obtained by doping tin oxide with antimony oxide; brand name: T-1, made by Mitsubishi Materials Corporation) and 40 parts by weight of alumina having an average particle size of 1 μm were added to 100 parts by weight of an acrylic-melamine resin (brand name: Honey Brite C-1L, made by Honey Chemical Co.,Ltd.). The resultant mixture was dispersed by a ball mill for 30 hours, and then diluted to 15% by weight with desalted water. In a paint containing 2.0% by weight of cyanine blue for coloring, electrodeposition was performed by utilizing the resultant substrate as the anode and a stainless sheet having a thickness of 0.5 mm as the cathode at an applying voltage of 70V for 3 minutes under the conditions of a bath temperature of 25° C. and pH 8–9. After electrodeposition, the substrate was washed and heated for 60 minutes in the oven at a temperature of 97° C.±1° C. so as to be cured. Thus, another electrodeposition coated material having a good outer appearance according to the present invention was obtained.

The thickness of the electrodeposition coating forming the electrodeposition coated material was 20 μm and the precipitated amount thereof was 40% by weight. Further, tests similar to those of Example 1 were performed by using this electrodeposition coated material. As a result, good advantages similar to those of Example 1 were obtained.

EXAMPLE 3

An ABS/PC alloy substrate (made by Denki Kagaku Kogyo K.K.) having a length of 100 mm, a width of 50 mm and a thickness of 0.7 mm was coated with an aluminum vapor-deposition film having a thickness of 1 μm and further treated with an aqueous solution containing 1% potassium dichromate for 1 minute at a temperature of 70° C.

50 parts by weight of a filler having an average particle size of 0.07 μm (the powder formed of the particles obtained by coating $TiO_2$ with $SnO_2$; brand name: FT-2000, made by Ishihara Sangyo Kaisha, Ltd.) and 2 parts by weight of alumina having an average particle size of 1 μm were added to 100 parts by weight of an acrylic-melamine resin (brand name: Honey Brite C-1L, made by Honey Chemical Co., LTd.). The resultant mixture was dispersed by a ball mill for 30 hours, and then diluted to 5% by weight with desalted water. In a paint containing 2.0% by weight of carbon black for coloring, electrodeposition was performed in a manner similar to Example 2. Thus, another electrodeposition coated material having a good outer appearance according to the present invention was obtained.

The thickness of the electrodeposition coating forming the electrodeposition coated material was 10 μm and the precipitated amount thereof was 35% by weight. Further, tests similar to those of Example 1 were performed by using this electrodeposition coated material. As a result, good advantages similar to those of Example 1 were obtained.

While the present invention has been described with reference to what are presently considered to be the preferred embodiments, as stated above, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrodeposition coated material comprising an electrodeposition paint coating on a non-metal substrate having a metal surface film, said electrodeposition paint coating comprising a fine powder in an acrylic-melamine resin, said fine powder comprising particles which consist essentially of (a) metal oxide particles coated with at least one different metal oxide or (b) metal oxide particles surface-doped with at least one different metal oxide, said metal oxide particles selected from the group consisting of titanium oxide, tin oxide, antimony oxide, indium oxide and zinc oxide, wherein said electrodeposition coated material has a volume resistivity from $10^2$–$10^9$ ohm·cm and said fine powder is present in amounts from 10 to 50% by weight based on the electrodeposition paint coating.

2. An electrodeposition coated material according to claim 1, further comprising an adhesion-improving coating between said electrodeposition paint coating and said substrate.

3. An electrodeposition coated material according to claim 1, wherein said (a) metal oxide particles coated with at least one different metal oxide are selected from the group consisting of titanium oxide particles coated with tin oxide and titanium oxide particles coated with zinc oxide and said (b) metal oxide particles surface-doped with at least one different metal oxide are selected from the group consisting of tin oxide particles doped with antimony oxide, indium oxide particles doped with antimony oxide, titanium oxide particles coated with tin oxide and then doped with antimony oxide and zinc oxide particles doped with antimony oxide.

4. The electrodeposition coated material of claim 1, wherein the average particle size of the fine powder is from 0.01 to 2.0 $\mu$m.

* * * * *

UNITED STATES PATENT AND TRADEMARK OFFICE

CERTIFICATE OF CORRECTION

PATENT NO. : 6,159,602
DATED : December 12, 2000
INVENTOR(S) : Susumu Kadokura et al.

It is certified that error appears in the above-identified patent and that said Letters Patent is hereby corrected as shown below:

Column 3,
Line 49, "oxide;" should read -- oxide; and --;
Line 51, "oxide;" should read -- oxide.--.

Column 8,
Line 50, LTd.)." should read -- Ltd.) --.

Signed and Sealed this

First Day of January, 2002

*Attest:*

*Attesting Officer*

JAMES E. ROGAN
*Director of the United States Patent and Trademark Office*